US005264243A

United States Patent [19]

Wedinger et al.

[11] Patent Number: 5,264,243

[45] Date of Patent: Nov. 23, 1993

[54] MASS CELLULOSE DEACIDIFICATION PROCESS

[75] Inventors: Robert S. Wedinger; Conrad W. Kamienski, both of Gastonia; Kent N. Smith, Bessemer City; George R. Sandor, Gastonia; A. Revonda Porch, Shelby; Sharon B. Smith, Gastonia, all of N.C.

[73] Assignee: FMC Corporation, Philadelphia, Pa.

[21] Appl. No.: 899,206

[22] Filed: Jun. 16, 1992

[51] Int. Cl.[5] ..... B32B 35/00

[52] U.S. Cl. ..... 427/140; 422/40; 427/296; 427/439; 556/122

[58] Field of Search ..... 427/140, 296, 439; 422/40; 556/122

[56] References Cited

U.S. PATENT DOCUMENTS

| | | | |
|---|---|---|---|
| 3,472,611 | 10/1969 | Langwell | 252/401 X |
| 3,676,182 | 7/1972 | Smith | 117/60 |
| 3,703,353 | 11/1972 | Kusterer et al. | 162/160 X |
| 3,778,401 | 12/1973 | Hayworth | 260/29.6 |
| 3,837,804 | 9/1974 | Walker et al. | 252/401 X |
| 3,939,091 | 2/1976 | Kelly | 427/421 X |
| 3,969,549 | 7/1976 | Williams et al. | 427/296 X |
| 4,051,276 | 9/1977 | Williams et al. | 427/296 X |
| 4,318,963 | 3/1982 | Smith | 427/296 X |
| 4,522,843 | 6/1985 | Kundrot | 427/180 X |
| 5,094,888 | 3/1992 | Kamienski et al. | 427/391 X |
| 5,104,997 | 4/1992 | Kamienski et al. | 427/430.1 X |
| 5,137,760 | 8/1992 | Lundquist | 427/439 |

OTHER PUBLICATIONS

White, Howard J. et al., *Mass Deacidification for Libraries,* Library Technology Reports, May–Jun., 1987, vol. 23, No. 3.

*Primary Examiner*—Michael Lusignan

*Attorney, Agent, or Firm*—Charles C. Fellows; Robert L. Andersen

[57] ABSTRACT

This invention provides a process for deacidifying paper by contacting the paper one or more times with hydrocarbon or halocarbon solutions of certain magnesium and/or zinc alkoxyalkoxides which may have been treated with carbon dioxide to yield low viscosity solutions, drying the books and rehydrating the books.

8 Claims, No Drawings

MASS CELLULOSE DEACIDIFICATION PROCESS

The present invention concerns a method of mass treatment of cellulosic materials by contacting predried cellulosic materials with certain alkylmagnesiumalkoxyalkoxide compositions dissolved in hydrocarbon solvents removing the solvent and retreating again with the alkylmagnesiumalkoxyalkoxide.

Once upon a time it was proposed in U.S. Pat. No. 3,676,182 to neutralize the acidity in paper, such as books, by treating the books with methylmagnesiumethoxide dissolved in a hydrocarbon solvent containing methyl alcohol. The high viscosity of the methylmagnesiummethoxide in the hydrocarbon/alcohol solvent system was reduced by carbonating the methoxide to produce methylmagnesium methoxy carbonate; U.S. Pat. No. 3,939,091. These compositions, while providing protection against acid-generated decomposition of cellulosic materials caused feathering of some inks, dissolved glue and otherwise had inherent problems which librarians and conservators found objectionable.

Chemical compositions offering significant improvements over the prior art in their ability to neutralize the acidity of paper and books, buffer the paper to the alkaline side to provide protection of the paper from post-treatment acid attack and improve paper performance are magnesium and zinc alkoxyalkoxides and their carbonated analogs are disclosed in U.S. Pat. No. 4,634,786. While the hydrocarbon and halocarbon solutions of these later compounds do not require the presence of alcohols in order to dissolve the alkoxyalkoxides, they, like the prior art, possess inherent problems which limit their acceptance by librarians and book conservators. Among these inherent problems are residual odor, tackiness of book covers, bluing of ink toners, translucency and oiliness of pages, discoloration or staining of pages and transfer of inks also termed feathering or ghosting. In general, these defects are due to the presence of and gradual increase in derived alkoxyalcohols generated by slow hydrolysis of the metal alkoxyalkoxides in the treated articles.

These defects can be minimized by decreasing the amount of metal salts incorporated into the book's paper but this also reduces the buffering power of the treatment chemicals to an unacceptably low level. Reducing the amount of deacidifying chemical incorporated into cellulosic material so that 0.5 weight percent magnesium carbonate equivalent is incorporated results in acceptable product deacidification and reduces defects; however, such reduction tends to be unacceptable because a value of 1.2 weight percent magnesium carbonate (1.5 weight percent calcium carbonate) equivalent is the generally accepted minimum that provides both deacidification and buffering of the treated cellulosic material. Thus, there is a need for a chemical and/or process that will adequately deacidify and buffer paper products and avoid the defects of the prior art.

The present invention provides a process for deacidifying cellulosic materials comprising (1) contacting the cellulosic material with a deacidification composition containing a hydrocarbon or halocarbon solution or mixtures thereof containing an effective amount of a composition selected from the group consisting of: (A) a substituted metal alkoxide having the formula $$X_yM(OR)_{2-y}(R^1OH)_x \qquad (I)$$

wherein:

(I) —OR is a group selected from 2-alkoxyalkoxy- and ω-alkoxypolyalkoxy- groups of the formula $$[-OCH(R^2)CH_2\text{-}(OCH(R^2)CH_2)_n\text{-}OR^3]$$

wherein $R^2$ is selected from H and $-CH_3$ and $R^3$ is selected from alkyl groups of 1 to 8 carbon atoms, cycloalkyl groups of 3 to 18 carbon atoms and aryl, arylalkyl and alkylaryl groups of 6 to 18 carbon atoms and n is a value of 1 to 20;

(II) X—is a group selected from (a) an organic group $-R^4$ wherein $R^4$ is selected from the group consisting of alkyl groups containing 1 to 18 carbon atoms, cycloalkyl groups containing 3 to 8 carbon atoms and aryl, arylalkyl and alkylaryl groups containing 6 to 18 carbon atoms;

(b) an acyloxy group of the formula $[-O(O)CR^4]$ wherein $R^4$ has the hereintobefore ascribed meaning;

(c) ω-alkoxypolyalkoxy- groups of the formula $$[-OCH(R^2)CH_2\text{-}(OCH(R^2)CH_2)_n\text{-}OR^3]$$

wherein $R^2$, $R^3$ and n have the hereintobefore ascribed meanings;

(d) an alkoxy group $-OR^4$ wherein $R^4$ has the hereintobefore ascribed meanings;

(III) M is a metal selected from magnesium, zinc and mixtures thereof;

(IV) $R^1OH$ is a compound in which $R^1O$ is a group selected from (e) alkoxy groups of the formula $R^4O$ wherein $R^4$ has the hereintobefore ascribed meanings;

(f) 2-alkoxyalkoxy- and ω-alkoxypolyalkoxy-groups of the formula $$[-OCH(R^2)CH_2\text{-}(OCH(R^2)CH_2)_n\text{-}OR^3]$$

wherein $R^2$, $R^3$ and n have the hereintobefore ascribed meanings;

(VI) y has a value between zero and two; and (VII) x has a value of zero to two;

(B) a carbonated substituted metal alkoxide having the formula $$X_yM(OR)_{2-y}(R^1OH)_x$$

in which either $X_y$ or —OR is carbonated wherein $R^1OH$, M, y and x have the hereintobefore ascribed meanings; and (I) —OR is a group selected from 2-alkoxyalkoxy-and ω-alkoxypolyalkoxy- groups of the formula $$[-OCH(R^2)CH_2\text{-}(OCH(R^2)CH_2)_n\text{-}OR^3]$$

wherein $R^2$ is selected from H and $-CH_3$ and $R^3$ is selected from alkyl groups of 1 to 18 carbon atoms, cycloalkyl groups of 3 to 18 carbon atoms and aryl, arylalkyl and alkylaryl groups of 6 to 18 carbon atoms and n is a value of 1 to 10; and (II) X- is a group selected from (a) an ω-alkoxypolyalkoxy- group of the formula $$[-OCH(R^2)CH_2\text{-}(OCH(R^2)CH_2)_n\text{-}OR^3]$$

wherein $R^2$, $R^3$ and n have the hereintobefore ascribed meanings; and, (b) an alkoxy group —$OR^4$ wherein $R^4$ has the hereintobefore ascribed meaning; and (c) mixtures of (A) and (B).

The compositions useful in practicing this invention are prepared by reacting a metal dialkyl with an alcohol in accordance with the teachings of U.S. Pat. No. 5,104,997 examples XIII to XV.

Surprisingly increasing the value of y in Formula I above to values above 1.0 unexpectedly results in a significant decrease in the degree of translucency and oiliness in the resulting treated book pages which allows the books to be treated a number of times successfully thereby increasing the buffer levels to an acceptable degree without encountering deleterious effects therein. The upper limits for y in Formula II in U.S. Pat. No. 5,104,997 is 1.0 and this patent contains no suggestion that any benefit would result from values of y in excess of 1.0.

While not being held to any theory as to why values of y in excess of 1.0 are desirable, it is possible that the alkoxyalkoxide portion of the compound is necessary to provide maximum penetration of the buffer into the book pages while the presence of the alkylmetal metal portion of the molecule provides a buffer which does not generate an alkoxyalcohol on hydrolysis and additionally delays formation of the latter, thus decreasing its deleterious effects on book components.

The concentration of treatment chemicals of Formula I and Formula II in the hydrocarbon solution can be varied widely from about 0.05 to 0.4 moles but it is generally preferred to use about 0.15 to 0.25 moles.

In a further aspect of this invention, after single or multiple treatment of the predried books have been carried out, for example, treating the books one or more times with one of the above described chemicals, with removal of the hydrocarbon solvent after each treatment the books are anerobically treated with water vapor at a reduced pressure using a number of cycles until a certain minimum amount of water has been introduced into the books, generally in the range of 2 to 18 liters per 36 to 37 kilograms of books. The amount of water can be varied so as to introduce as much as 2 to 10% based on the weight of the books. The reduced pressure is such that the water being introduced does not condense on the books as liquid water. The reduced pressure range over which the water is introduced is typically from 1 mm (130 pascals) to 100 mm (13,300 pascals) but can vary from 0.1 mm Hg (10 pascals) to 150 mm Hg (20k pascals). This treatment with water can be done in the same chamber or can be conducted in a separate chamber. Likewise the books can be dried in the treatment chamber or in a separate chamber such as a vacuum dryer. The drying may involve heating by conventional heating or using dielectric energy provided the books are separated by dielectrically active separator sheets or spacers or using microwave energy.

Optionally, after hydration is completed, the books may be rinsed with a dilute solution of a $C_1$–$C_3$ alcohol in a hydrocarbon or halocarbon solvent and then finally dried, as above.

The resulting treatment gives books which possess little or no odor, a much reduced degree of tacky covers, no ghosting, bluing or translucency, and a significant decrease in the amount of discoloration, while at the same time increasing the buffer content (wt % $MgCO_3$) by at least a factor of 2. The following table shows these comparisons, both immediately after removal from the dryer and after 14 days in an ambient atmosphere. It should be noted that ink transfer and translucency of pages do not appear after 14 days at ambient conditions in the case of books treated by our invention, as compared to the method of U.S. Pat. No. 5,104,997, where these effects worsen with time.

| | (Run 108) Mg bis-Alkoxyalkoxide[a] | | (Run 120) $(Alkyl)_{1.2}Mg$ $(Alkoxyalkoxide)_{0.8}$[b] | |
|---|---|---|---|---|
| No. of Treats | 1 | | 2 | |
| Av % $MgCO_3$ | 0.8 | | 2.0 | |
| pH | 8.4 | | 9.5 | |
| | Run 108 | | Run 120 | |
| Observations - | 0 days | 14 days | 0 days | 14 days |
| % Ink Transfer or Feathering | 6 | 21 | 0 | 0 |
| % Brown Staining | 100 | 100 | 19 (slight) | 19 (slight) |
| % Tacky Covers | 15 | 15 | 3 | 3 |
| % Ghosting | 6 | 6 | 0 | 0 |
| % Translucency | 0 | 24 | 0 | 0 |
| Odor | Unpleasant | Same | None | Noticeable |

[a]Magnesium bis-butoxytriglycolate (carbonated)
[b]Butylmagnesiumbutoxytriglycolate The mechanism of this improved activity of the present invention is not known, but could be due to the deeper penetration of the hydrolyzed by-product alkoxyalcohol into the tertiary structures of the paper fibers, thus leading to fewer externally noted effects, such as odor, translucency, effects on inks, and discoloration. Additional effects could be due to improved volatilization of lower boiling odoriferous components of the by-product alkoxyalcohols, or to the lesser amount of alkoxyalkoxide structures per molar unit of buffer, although the double treatment shown above should have provided an equal amount of alkoxyalkoxide.

After hydration, the books or papers may be treated with a dilute solution of a lower mol. wt. $C_1$–$C_3$ alcohol or mixtures thereof in a hydrocarbon or halocarbon solvent to promote removal of surface-containing higher boiling by-product alkoxyalcohols or butanols, and the so-treated books or papers further heated under vacuum to remove residual solvents.

The general principle of this invention is to convert all magnesium alkoxides or alkylmagnesium alkoxides to their respective alkanes and alcohols or alkoxyalcohols by treatment with water vapor, and then subsequently to use a variety of means to remove or alter the site of residency of these by-products, such as by evacuation, rinsing, displacement with a lower boiling alcohol, etc., thus resulting in a cellulosic product containing buffer (Mg) in a "fixed" form, but containing no deleterious by-products.

The advantage of a double treat (or a multiple treat, if desired) is that it results in a more even distribution of the buffer in the treated article. Thus, one of the books doubly treated with the alkylmagnesium alkoxyalkoxide (above) was analyzed for pH and % $MgCO_3$ content both across the pages of the book, as well as within a single page taken from the middle of the book. The results are as follows:

| Run 120 | | | | | |
|---|---|---|---|---|---|
| Book Distribution | Page from Front of Book | Page from Front-Middle of Book | Page from Center of Book | Page from Center-Back of Book | Page from Back of Book |
| pH | 9.2 | 9.4 | 9.4 | 9.3 | 9.5 |
| % $MgCO_3$ | 2.24 | 2.79 | 2.57 | 2.07 | 2.29 |
| Av pH = 9.36 | | | | | |
| Av % $MgCO_3$ = 2.39; sd = 0.29 (12%) | | | | | |
| Page Distribution | Top Left Corner of Page | Top Right Corner of Page | Bottom Left Corner of Page | Bottom Right Corner of Page | |
| pH | 9.6 | 9.6 | 9.6 | 9.7 | |
| % $MgCO_3$ | 2.66 | 2.37 | 2.46 | 2.72 | |
| Av pH = 9.6 | | | | | |
| Av % $MgCO_3$ = 2.55; sd = 0.16 (%) | | | | | |

Excellent distribution of buffer is noted both across the pages of the book and within a single page of the book.

EXAMPLE 1

Fifty-six books weighing 84 pounds (38 kg) and fifty sheets of 8½×11" (21 cm×28 cm) of acidic papers, comprising three different papers (Strathmore bond, Williamsburg bond and news print paper) were closely packed in four perforated polypropylene containers. The book and paper filled containers were then placed on the shelves of a vacuum dryer. Two of the filled containers were placed on the lower shelf of the two shelf dryer and the other two filled containers were placed on the upper shelf. The dryer, containing the filled containers, was then sealed and vacuum and heat was applied for 48 hours. The heat was supplied by 160° F. (71° C.) water which was circulated through passages in the shelves or trays thereby slowly heating the books to 140° F. (60° C.). The vacuum pressure was applied constantly during the 48 hour period; initially the vacuum was 87 mm Hg (11.2 pascals) and at the end of the 48 hours the vacuum pressure measured 0.2 mm Hg. The circulation of warm water through the shelf passages was terminated at which time the internal temperature of the books was 140° F. (60° C.).

A treatment solution containing a sufficient amount of a 50:50 mixture by weight of magnesium bis-butoxytriglycolate and dibutylmagnesium to provide a 0.23 M mixture in 400 gallons (1,516 liters) of heptane was introduced into the shelf dryer under vacuum so as to immerse the books and sheets of paper in the solution. The books were immersed for ten minutes. The solution temperature during treatment was 77° F. (25° C.). After the ten minute immersion or treatment period the solution was drained off the books. After the solution was drained full vacuum and 160° F. (71° C.) heating water were again applied to the vacuum dryer for five hours to remove the heptane. After five hours the heating and vacuum were discontinued and the book filled containers were retreated with 400 gallons (1500 liters) of heptane containing a 0.23 M solution of the 50:50 magnesium bis-butoxytriglycolate dibutylmagnesium mixture for 10 minutes at 77° F. (25° C.). Again the heptane is evaporated from the books by heating the shelf dryer with water whose temperature was 160° F. (71° C.) and employing full vacuum; the maximum capacity of the vacuum pump was employed and after 14 hours the vacuum pressure was 0.2 mm Hg ( pascals). The books were then rehydrated using a cycling procedure in which 100 to 400 milliliters of water was introduced into the dryer and vaporized onto the top shelf at 160° F. while allowing the vacuum pressure to increase from 30 to 27 inches of Hg (10.1 k pascals); the water vapor was allowed to equilibrate in the books for 15 minutes after which the vacuum pressure of 30 inches of Hg was restored. This rehydration cycle was repeated varying the amount of water introduced per cycle between 100 and 400 milliliters until a total of 11 liters of water had been introduced into the vacuum dryer which took 18 hours. The processing was then complete and the books were removed from the dryer.

Two books were further treated by immersion in a heptane-ethanol rinse solution (5% by volume ethanol) for ten minutes at 77° F. (25° C.). The solution was then drained from the books and the remaining solvent solution was removed by applying full vacuum and using shelf temperatures of 160° F. (71° C.) for 12 hours.

The empirical results of the experiment are given below. The results show that the three loose control papers that were placed in the trays had an average pH of 9.6 and an average % $MgCO_3$ of 1.77 after treatment. Papers in the middle of five books were also examined and had an average pH of 8.96 and an average % $MgCO_3$ of 1.79.

| Example 1: Post-Treatment Variable Evaluation | |
|---|---|
| Solution molarity | 0.23 |
| Drying Time (hours) | 48 |
| Drying Temperature °F.* | 140 |
| Strathmore pH | 9.7 |
| Williamsburg pH | 9.4 |
| Newsprint pH | 9.4 |
| Average control pH | 9.6 |
| Strathmore % $MgCO_3$ | 1.93 |
| Williamsburg % $MgCO_3$ | 1.62 |
| Newsprint % $MgCO_3$ | 1.75 |
| Average % $MgCO_3$ | 1.77 |
| books middle page (average of 5 books) | |
| average pH | 8.96 |
| high pH | 9.40 |
| low pH | 8.30 |
| books middle page (average of 5 books) | |
| average % $MgCO_3$ | 1.79 |
| high % $MgCO_3$ | 2.35 |
| low % $MgCO_3$ | 0.98 |

*final internal book temperature (60° C.)

Pages were selected from different areas of one book and were tested to find how even the treatment is within a book and how even the treatment is for a given page in the center of the book. The results are given below.

| Book distributions are as follows: | | | | | |
|---|---|---|---|---|---|
| | pg 31 front | pg 151 front middle | pg 271 middle | pg 330 back middle | pg 378 back |
| pH | 9.4 | 9.6 | 9.3 | 9.2 | 9.5 |
| % $MgCO_3$ | 1.75 | 1.77 | 1.56 | 1.84 | 2.01 |
| **Page distributions are as follows:** | | | | | |
| | Top left | Top right | Bottom left | Bottom right | |
| pH | 9.6 | 9.5 | 9.8 | 9.5 | |
| % $MgCO_3$ | 2.18 | 1.75 | 2.01 | 2.12 | |

After treatment each book was visually examined and the center pages were sprayed with a Fisher Scientific Universal pH indicator solution.

| Post Evaluation Inspection Initial Observation: | |
|---|---|
| Number of Books | 58 (84 lbs) |
| Discoloration, slight | 17% |
| Ink Feathering | 0% |
| Paperback Ungluing | 0% |
| Circular untreated section | 0% |
| Tacky Covers | 1% |
| Residual powder | 0% |
| Paper Bluing | 0% |
| Translucent | 0% |
| Uneven distribution | 0% |
| Acidic | 0% |

The results show that 17% of the books had very slight discoloration on the pages of the books, 1% of the book covers had a tacky feeling, and all were completely deacidified. In addition to visual observations the books were examined for odor. After the 11 liters of water were added only a very slight odor was apparent in the center of the books. Books that were rinsed in the alcohol solution had no odor present.

COMPARATIVE EXAMPLE —MULTIPLE VS SINGLE TREATS

Three runs were carried out in a 25 gallon (95 liter) steel tank treating unit using four standard books:

1. "A Season Inside"—alkaline book
2. "The Queen of the Damned"—alkaline book
3. "The Great Divide"
4. Catholic Encyclopedia After drying to 2% moisture (contained) these were placed in a standard wire basket with spacer wires. About 150–200 lbs. (91 kg) of 0.05 M carbonated magnesium bis-butoxytriglycolate treat solution was used to cover the books, and about the same amount of <0.01M carbonated magnesium bis-butoxytriglycolate rinse solution in a later treatment. A stirrer placed below the level of the basket served to agitate the solutions during treat and rinse periods.

Multiple treats were effected by drying the books for various times after treatment, then retreating them for the desired length of time and then finally drying them completely.

The treatment effectivity of each run was determined by carrying out the following tests on pages taken from the book:

1. Magnesium Content
   a) Front, middle and back of book (book distribution)
   b) Single page taken from middle of book and cut into three sections (page distribution)

DISCUSSION OF RESULTS

A series of three runs was carried out under a variety of conditions between treatments, to determine the best conditions for carrying out such multiple treatments using four standard books per run as described in the experimental section.

Table I summarizes the results of these runs showing the individual book and page distributions based on magnesium, The results can be broken down into:

a) Differences in magnesium pickup
b) Differences in book distribution (magnesium)
c) Differences in page distribution (magnesium)

(a) Differences in Magnesium Pickup

There is an appreciable uptake of Mg if the two equal 5 minute treatments are separated by a 5 hour drying period (run 73), as compared to a single 10 minute treat (run 69).

If the number of treats is increased to three, still keeping the overall treatment time to 10 minutes (see run 79), then a still further increase in magnesium is noted.

The maximum increase in Mg uptake on going from one to two treats is about 50%, while the maximum increase in Mg uptake on going from one to three treats is about 90%. It should be noted that no rinsing is carried out after any intermediate treatments, only after the last one.

(b) Differences in Book Distribution

Book distribution (RSD) appears to improve with multiple treats (same solvent) generally averaging about 10% (versus 20–30% for a single treat. See Table 2.) There is no significant difference among the various multiple treat conditions employed.

(c) Differences in Page Distribution

Page distribution of magnesium after treatment was determined by dividing a middle page taken from each book into three sections.

In-page distribution is improved by (a) rinsing after the first treat in a two treat system and (b) totally drying between treats.

The above examples illustrate the following:

1. Magnesium (buffer) concentration in books can be significantly increased by multiple treating.
2. Book distribution of magnesium is also significantly improved by the use of multiple treating.
3. Page distribution of buffer is not significantly improved unless rinsing is carried out after each treat segment.

TABLE 1

MULTIPLE TREAT RUNS - SUMMARY OF RESULTS

| RUN NO. | TREAT(a) CONDITION | CONDITION(b) BETWEEN TREATS | RINSE(c) | BOOK NO. | Mg BOOK(f) AVG | Mg BOOK(f) RSD | Mg PAGE(g) AVG | Mg PAGE(g) RSD |
|---|---|---|---|---|---|---|---|---|
| 69 | 10 | | 10 | 1 | 0.72 | 26 | 0.41 | 71 |
| | | | | 2 | 0.68 | 37 | 0.43 | 26 |
| | | | | 3 | 0.56 | 30 | 0.48 | 33 |
| 73 | 2 × 5 | 5 hours | 10(h) | 1 | 1.11 | 4 | 1.02 | 28 |
| | | | | 2 | 1.03 | 14 | 1.17 | 7 |

TABLE 1-continued

MULTIPLE TREAT RUNS - SUMMARY OF RESULTS

| RUN NO. | TREAT(a) CONDITION | CONDITION(b) BETWEEN TREATS | RINSE(c) | BOOK NO. | Mg BOOK(f) AVG | Mg BOOK(f) RSD | Mg PAGE(g) AVG | Mg PAGE(g) RSD |
|---|---|---|---|---|---|---|---|---|
| | | | | 3 | 1.04 | 10 | 0.89 | 15 |
| | | | | 4 | 1.06 | 17 | 0.93 | 27 |
| 79 | First - 4 | 2 hours | 10 | 1 | 1.32 | 5 | 1.09 | 50 |
| | Second - 3 | | | 2 | 1.36 | 9 | 1.05 | 64 |
| | Third - 3 | | | 3 | 1.26 | 6 | 1.02 | 55 |
| | | | | 4 | 1.29 | 18 | 1.45 | 23 |

(a)Treat time in minutes; all books were predried under vacuum at 50° to 2% $H_2O$ content before treatment.
(b)Drying time in hours (vacuum, 50–60° C.)
(c)Rinse time in minutes
(f)Front, middle, and back pages taken and values averaged
(g)Middle page divided into three sections and values averaged
(h)Rinse after first treat

TABLE 2

MULTIPLE TREAT RUNS - AVERAGE DISTRIBUTIONS (BOOK & PAGE)

| RUN NO. | TREAT CONDITION | CONDITION BETWEEN TREATS | RINSE | AV. BOOK DISTRIBUTION (Mg) AVG | AV. BOOK DISTRIBUTION (Mg) s | AV. BOOK DISTRIBUTION (Mg) RSD | AV. PAGE DISTRIBUTION (Mg) AVG | AV. PAGE DISTRIBUTION (Mg) s | AV. PAGE DISTRIBUTION (Mg) RSD |
|---|---|---|---|---|---|---|---|---|---|
| 69 | 10 | — | 10 | 0.71 | 0.21 | 30 | 0.46 | 0.22 | 49 |
| 73 | 2 × 5 | 5 | 10 | 0.57 | 0.03 | 5 | 0.53 | 0.13 | 26 |
| | | | | 1.06 | 0.12 | 11 | 1.00 | 0.19 | 19 |
| 79 | 1 × 4 | 2 | 10 | | | | | | |
| | 1 × 3 | 2 | 10 | | | | | | |
| | 1 × 3 | 2 | 10 | 1.31 | 0.13 | 9.5 | 1.15 | 0.53 | 48 |

We claim:

1. A process for deacidifying cellulosic materials comprising (1) contacting the cellulosic with a deacidification composition containing a hydrocarbon solution containing an effective deacidifying amount of a composition selected from the group consisting of:

(A) a substituted metal alkoxide having the formula $$X_yM(OR)_{2-y}[(R^1OH)_x]$$

wherein (I) —OR is a group selected from 2-alkoxyalkyoxy- and ω-alkoxypolyalkoxy- groups of the formula $$(OCH(R^2)CH_2\text{-}(OCH(R^2)CH_2O)_n\text{-}OR^3)$$

wherein $R^2$ is selected from H and —$CH_3$ and $R^3$ is selected from alkyl groups of 1 to 8 carbon atoms, cycloalkyl groups of 3 to 18 carbon atoms and aryl arylaklyl and alkylaryl group of 6 to 18 carbon atoms and n is a value of 0 to 20;

(II) X- is an organic group —$R^4$ wherein $R^4$ is selected from the group consisting of alkyl groups containing 1 to 8 carbon atoms and aryl, arylalkyl and alkylaryl groups containing 6 to 18 carbon atoms;

(III) M is a metal selected from magnesium, zinc and mixtures thereof;

IV y has a value between one and two.

2. The process of claim 1 wherein the solution is a 0.01 to 1 molar solution of the substituted metal alkoxide.

3. The process of claim 2 wherein the solution is a 0.02 to 0.5 molar solution of the substituted metal alkoxide.

4. The process of claim 2 wherein the solution is a 0.05 to 0.25 molar solution of the substituted metal alkoxide.

5. The process of claim 1 wherein said substituted metal alkoxides are alkylmetal 2-alkoxyalkoxy-, and alkylmetal ω-alkoxypolyalkoxides $R^4_yM[OCH(R^2)CH_2(OCH(R^2)CH_2)_n\text{-}OR^3]_{2-y}$, where $R^2$ is selected from hydrogen and a methyl group and $R^4$ and $R^3$ are the same or different $C_1$ to $C_8$ alkyl groups, y is a value from 0.5 to 1.5, and n is a value from 1 to 10.

6. The process of claim 1 wherein the substituted metal alkoxides are selected from the group of magnesium and zinc alkoxides, and mixtures thereof.

7. The process according to claim 5 wherein said alkylmetalalkoxyalkoxides and alkylmetal ω-alkoxypolyalkoxides are selected from butylmagnesium ω-methoxypolyethoxide, ethylzinc ω-methoxypolyethoxide butylmagnesium butoxytriglycolate, and mixtures thereof.

8. The process according to claim 1 wherein the hydrocarbon solvent is selected from the group consisting of pentane, hexane, heptane, benzene, toluene, cyclohexane, ethane, propane, butane, propylene and mixtures thereof.

* * * * *